US005343229A

United States Patent [19]

Ohshima

[11] Patent Number: 5,343,229

[45] Date of Patent: Aug. 30, 1994

[54] INK JET PRINTER

[75] Inventor: Keiichi Ohshima, Nagano, Japan

[73] Assignee: Seiko Epson Corporation, Tokyo, Japan

[21] Appl. No.: 899,851

[22] Filed: Jun. 17, 1992

[30] Foreign Application Priority Data

Jun. 18, 1991 [JP] Japan ..... 3-174655

[51] Int. Cl.[5] ..... B41J 11/20

[52] U.S. Cl. ..... 347/8; 400/55; 347/104

[58] Field of Search ..... 346/140 R; 400/55, 56, 400/58, 59

[56] References Cited

U.S. PATENT DOCUMENTS 4,843,338 6/1989 Rasmussen et al. ..... 346/140 R

FOREIGN PATENT DOCUMENTS 0334548 9/1989 European Pat. Off. .

60-180876 9/1985 Japan .

*Primary Examiner*—Benjamin R. Fuller

*Assistant Examiner*—J. E. Barlow, Jr.

*Attorney, Agent, or Firm*—Sughrue, Mion, Zinn, Macpeak & Seas

[57] ABSTRACT

An ink jet printer, including a gap regulating member that can forward a recording medium correctly by causing the recording medium to approach a recording head as closely as possible involving minimal parts. An upper surface of the gap regulating member serves as a surface for guiding travel of an ink jet head and a lower surface thereof serves as a surface for guiding a recording medium. The gap regulating member is disposed adjacent to a start end of an upwardly rotating region on a sheet feed roller in such a manner that the gap regulating member intersects a circumferential surface of the sheet feed roller at a small angle.

2 Claims, 1 Drawing Sheet

INK JET PRINTER

BACKGROUND OF THE INVENTION

The invention relates to ink jet printers and, more particularly, to an ink jet printer having a mechanism forwarding a recording medium to a recording position.

Printers of a type generally called "ink jet printers" are designed to record data either by deforming a single or a plurality of piezoelectric elements selected by a recording signal or by heating a single or a plurality of electric resistors selected by a recording signal to thereby produce bubbles in the region or regions of ink, and then by pressuring the ink in the region or regions to thereby jet the ink onto a recording sheet in the form of droplets. For this reason, a printer of this type requires a recording sheet be located as close to a recording head as possible to allow jetted ink droplets to reach the recording sheet correctly and efficiently. In addition, the printer requires that the recording sheet be forwarded out of touch of the recording head so that the recording sheet is free from ink stains.

Printers proposed in Japanese Patent Unexamined Publications Nos. 239073/1988 and 139286/1989 are designed to cause a recording sheet that has been sent by a sheet feed roller to be bent reversely so that the sheet can be fitted with the platen at a position immediately before the recording head. These printers are excellent in making the recording sheet out of contact with the recording head and minimizing the gap between the recording sheet and the recording head. However, these printers also address gap control problems, such as having to maintain a constant gap between the head and the platen through a carriage guide and adjusting a gap between the recording sheet and the head by pressing the platen down.

SUMMARY OF THE INVENTION

The invention has been made in view of such circumstances. Accordingly, an object of the invention is to provide a novel ink jet printer that can forward a recording medium correctly by causing the recording medium to approach a recording head as closely as possible involving minimal parts.

To achieve the above object, the invention is applied to an ink jet printer that includes a gap regulating member. An upper surface of the gap regulating member serves as a surface for guiding travel of an ink jet head and a lower surface thereof serves as a surface for guiding forwarding of a recording medium. The gap regulating member is disposed adjacent to a start end of an upwardly rotating region on a sheet feed roller in such a manner that the gap regulating member intersects a circumferential surface of the sheet feed roller at a small angle.

DETAILED DESCRIPTION OF THE PREFERRED EMBODIMENTS

Figure 1:
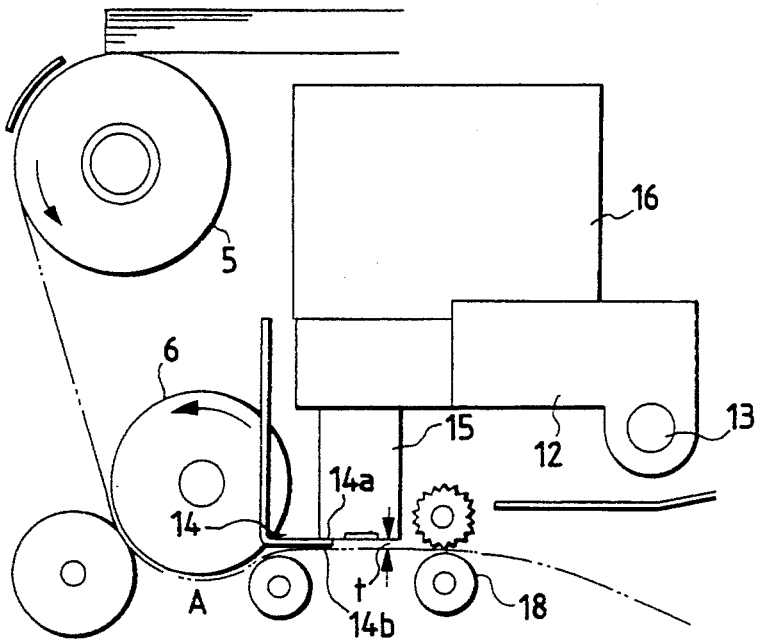
FIG. 1 is a diagram showing the configuration of a main portion of the invention.

An embodiment of the invention illustrated in the drawings will now be described.

The general appearance of an ink jet printer, which is an embodiment of the invention, will be described first with reference to FIG. 2.

Figure 2:
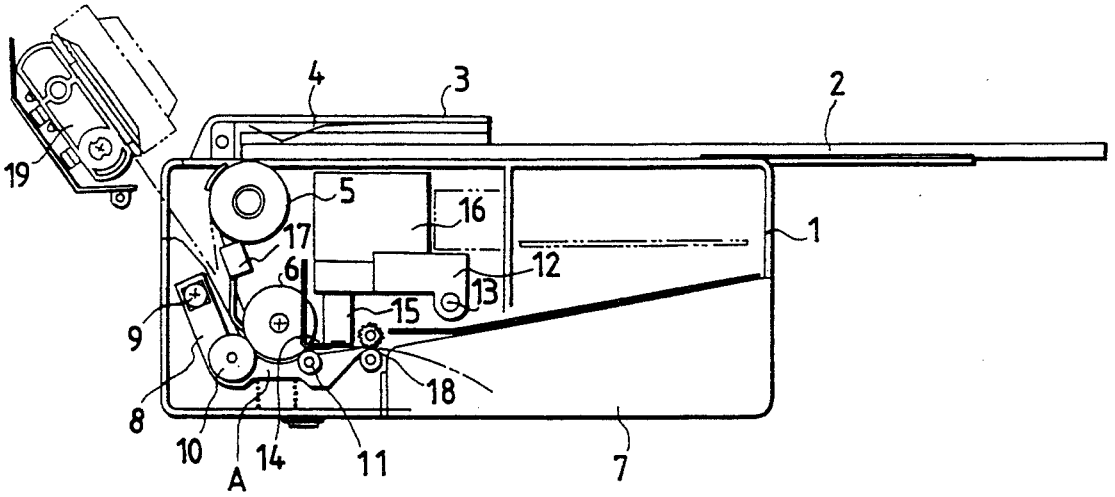
FIG. 2 is a diagram showing the general appearance of an ink jet printer having the main portion shown in FIG. 1, which is an embodiment of the invention.

In FIG. 2, a box-like printer body frame designated by reference numeral 1 has a sheet feed tray 2 to place cut sheets thereon. Inside the body frame 1 is a separating roller 5, which is located below a front end of the sheet feed tray 2 so that the lowermost of the cut sheets accumulated on the sheet feed tray 2 can be forwarded sequentially toward a print section.

Reference numeral 6 designates a sheet feed roller disposed below the separating roller 5. The sheet feed roller 6 is designed to cause the cut sheet from the separating roller 5 to circumferentially travel along the roller 6 by a quadrant thereof while holding the cut sheet frictionally thereon so that the cut sheet can be forwarded onto a sheet discharge tray 7 disposed at a lower portion of the body frame 1 from a lowermost point A via the print section that will be described later.

Reference numeral 8 designates a biasing lever that causes the cut sheet to come in pressure contact with the circumferential surface of the sheet feed roller 6. The biasing lever 8 is pivotably supported by a support shaft 9 on the upper end thereof so as to be oscillatable. In the case of feeding a continuous sheet from a separately arranged pull tractor 19, the biasing lever 8 is operated so as to release pinch rollers 10, 11 from the circumferential surface of the sheet feed roller 6, the pinch rollers 10, 11 being carried by the biasing lever 8.

Reference numeral 12 designates a carriage that is disposed within a C-shaped space surrounded by the sheet feed tray 2, the sheet discharge tray 7, the separating roller 5, and the sheet feed roller 6. The carriage 12 is guided by a guide rod 13 on one end thereof and by a gap regulating plate 14 (described later) on the other end thereof. And the carriage 12 causes a printer head 15 that the carriage 12 carries thereon to travel in a main scanning direction together with an ink cartridge 16.

Still referring to FIG. 2, reference numeral 3 designates a cover that covers the front half of the sheet feed tray 2; 4, a spring for biasing a cut sheet onto the separating roller 5; 17, a sheet detecting sensor; 18, a pair of sheet discharge rollers disposed between the print section and the sheet feed tray 7. One of the pair of sheet discharge rollers 16 which comes in contact with a print surface is designed as a GIZA roller that comes in point contact with the sheet surface.

By the way, FIG. 1 shows a main portion of the abovementioned printer of the invention in enlarged form.

As is apparent from FIG. 1, the gap regulating plate 14 is given two functions: one is that the upper surface thereof forms a travel guide surface **14*a* for the carriage 12 or the ink jet head 15, and the other is that the lower surface thereof forms a recording sheet guide surface 14*b*** that guides the print surface side of the cut sheet.

As a result, the gap regulating plate 14 is arranged at a position that is close to the start end of an upwardly rotating region on the sheet feed roller 6. More particularly, the gap regulating plate 14 is located at a position on the sheet feed roller 6 which is more or less downstream from the lowermost point A in the rotating direction. The gap regulating plate 14 is designed in terms of shape as a substantially horizontal plate body that protrudes slightly outward from a tangent extending from the circumferential surface of the sheet feed roller 6 to the head 15. The upper surface **14*a* of the gap regulating plate 14 supports a side end surface of the carriage 12 or the head 15 from below. On the other hand, the lower surface 14***b* of the gap regulating plate 14 which intersects the circumferential surface of the sheet feed roller 6 at a small angle confines the print surface side (upper surface) of the cut sheet, which has been curled in upwardly bent form by the circumferential surface of the sheet feed roller 6, in such a manner that the thus curled cut sheet is held down horizontally while curled in downwardly bent form. And restoring force applied at this time is utilized to provide a smallest possible gap corresponding to a thickness t of the gap regulating plate 14 between the cut sheet and the head 15, so that the cut sheet can be forwarded horizontally toward the pair of rollers 18 through the space without the platen.

In the thus constructed printer, if a cut sheet (or a continuous sheet) is fed from the separating roller 5 (or the pull tractor 19) to the sheet feed roller 6, then the sheet feed roller 6 forwards the cut sheet from the lowermost point A to the gap regulating plate 14 while holding the cut sheet frictionally thereon. The cut sheet becomes temporarily curled in upwardly bent form by being in intimate contact with the circumferential surface of the sheet feed roller 6, and the print surface thereof then comes in sliding contact with the horizontally extending recording sheet guide surface 14*b* of the gap regulating plate 14 at a small angle. At this point, the cut sheet is forcibly warped reversely to temporarily hold a straight position. It is during this time that the cut sheet is subjected to a predetermined recording process by ink droplets jetted out of the ink jet head 15. The recorded cut sheet is then discharged to the sheet discharge tray 7 aided by sheet discharge force applied from the pair of sheet discharge rollers 18.

In the meantime, since the carriage 12 travels with one end thereof being guided by the upper surface 14*a* of the gap regulating plate 14, the cut sheet can be forwarded with a gap determined by the thickness t of the gap regulating plate 14 at all times irrespective of the thickness of the sheet. As a result, the ink jet head 15 can record sharp images on the recording surface by jetting ink droplets onto the thus forwarded cut sheet.

As described in the foregoing pages, the invention is characterized as providing the gap regulating member, whose lower surface serves as a recording medium guide surface, at a position close to the start end of an upwardly rotating region on the sheet feed roller in such a manner that the gap regulating member forms a small angle with the circumferential surface of the sheet feed roller. Therefore, the recording medium that has temporarily been curled in upwardly bent form by the sheet feed roller in the sheet forward process can be curled in downwardly bent form by the gap regulating plate arranged at the position immediately thereafter. This causes the cut sheet to be temporarily flattened, thereby allowing the recording medium to confront the head with the least possible gap therebetween without a platen.

Further, since the upper surface of the gap regulating member serves as a surface for guiding travel of the ink jet head and the lower surface thereof as a surface for guiding the recording medium, the distance between the head and the recording medium can be maintained correctly by the gap regulating men%her itself, independently of the accuracy of machining and assembling respective components. In addition, members such as the platen can be dispensed with, which contributes to reducing the number of components and the number of assembling steps to a significant degree.

Still further, the invention is characterized as locating the recording position adjacent to the start end of an upwardly rotating region of the sheet feed roller, i.e., at a position more or less downstream from the lowermost point of the sheet feed roller. Therefore, the ink jet head including the ink cartridge is allowed to travel within a space whose lowermost point is higher than that of the sheet feed roller. As a result, not only the height of this type of printer can be reduced, but also the surface area thereof can be reduced to such an extent as to be as close to the size of a recording medium occupying the total projected area of the printer as possible.

While the present invention has been described above with respect to two preferred embodiments thereof, it should of course be understood that the present invention should not be limited only to these embodiments but various changes or modifications may be made without departure from the scope of the present invention as defined by the appended claims.

What is claimed is:

1. An ink jet printer including:

an ink jet head;

a sheet feed roller, a pinch member proximate the sheet feed roller; and a gap regulating member having an upper surface for guiding travel of said ink jet head and a lower surface for guiding a recording medium, said gap regulating member having a generally planar portion having one edge disposed adjacent to a start end of an upwardly rotating region on said sheet feed roller and extending away from said sheet feed roller toward said ink jet head in such a manner that said planar portion of said gap regulating member intersects a circumferential surface of said sheet feed roller at a small angle, whereby after said recording medium is forcibly upwardly curved toward said lower surface of said gap regulating member by said pinch member, said recording mediums is guided toward said ink jet head so as to be printed upon by said ink jet head without a platen.

2. An ink jet printer according to claim 1, in which said gap regulating member protrudes slightly outward from a tangent extending from the circumferential surface of said sheet feed roller to said ink jet head.

* * * * *